US005699640A

United States Patent [19]

Bourgeois et al.

[11] Patent Number: 5,699,640

[45] Date of Patent: Dec. 23, 1997

[54] FOAM BUILDING BLOCK

[75] Inventors: Kenneth W. Bourgeois; Thomas R. Morris; Joseph R. Morris; John F. Morris, all of Melbourne, Fla.

[73] Assignee: Southeast Walls, Inc., Melbourne, Fla.

[21] Appl. No.: 622,121

[22] Filed: Mar. 26, 1996

[51] Int. Cl.[6] ..... E04C 1/00

[52] U.S. Cl. ..... 52/309.4; 52/405.2; 52/592.1; 52/592.6; 52/606

[58] Field of Search ..... 52/592.1, 592.2, 52/592.6, 309.15, 309.4, 426, 405.1, 405.2, 405.3, 405.4, 604, 605, 606, 607, 609

[56] References Cited

U.S. PATENT DOCUMENTS

| | | | |
|---|---|---|---|
| 1,884,319 | 10/1932 | Smith | 52/405.2 |
| 2,126,011 | 8/1938 | Hedinger | 52/606 X |
| 2,216,875 | 10/1940 | Cline . | |
| 2,684,589 | 7/1954 | Perreton . | |
| 3,982,369 | 9/1976 | Keleske | 52/604 X |
| 4,018,018 | 4/1977 | Kosuge . | |
| 4,075,808 | 2/1978 | Pearlman . | |
| 4,319,440 | 3/1982 | Rassias et al. | 52/605 X |
| 4,439,967 | 4/1984 | Dielenberg . | |
| 4,485,604 | 12/1984 | Palamara et al. | 52/606 X |
| 4,527,373 | 7/1985 | Cruise | 52/405.1 |
| 4,884,382 | 12/1989 | Horobin . | |
| 4,894,969 | 1/1990 | Horobin . | |
| 5,014,480 | 5/1991 | Guarriello et al. . | |
| 5,123,222 | 6/1992 | Guarriello et al. . | |
| 5,379,565 | 1/1995 | Vienne . | |
| 5,428,933 | 7/1995 | Philippe . | |
| 5,465,542 | 11/1995 | Terry . | |

FOREIGN PATENT DOCUMENTS

| | | | |
|---|---|---|---|
| 243174 | 2/1926 | Italy | 52/604 |

*Primary Examiner*—Lanna Mai

*Attorney, Agent, or Firm*—James Creighton Wray

[57] ABSTRACT

Stackable and connectable foam building blocks include pairs of parallel side walls and opposite end walls extending between ends of side walls and multiple transverse members extending between the side walls at regular intervals. Each end wall has a U-shaped cutout section at its top to allow concrete flow between cavities of adjacent blocks and for supporting rebars. The upper edge of the end wall defining the lower part of the U-shaped section gradually increases from the outer surface to the inner surface of the end wall to form a downward and inward sloping surface for the lower part of the U-shaped section. Each transverse member includes a pair of structures substantially identical to the end walls. The two structures are positioned back-to-back, such that each cutout surface slopes inward and downward from the middle of the transverse member towards the adjacent cavity and a ridge is formed where the two sloping surfaces meet. The inner surfaces of the side walls, transverse members and end walls defining the cavities have a substantially vertical upper portion, an inward and downward sloping intermediate portion and an outward and downward sloping bottom portion. The inner surfaces of the side walls are curved where the side walls meet the transverse members and the end walls, giving the cavities a generally octagonal shape. Stacking members on upper and lower edges of the side walls, and connectors on outer surfaces of end walls connect blocks in a horizontal rows.

22 Claims, 3 Drawing Sheets

FIG. 4
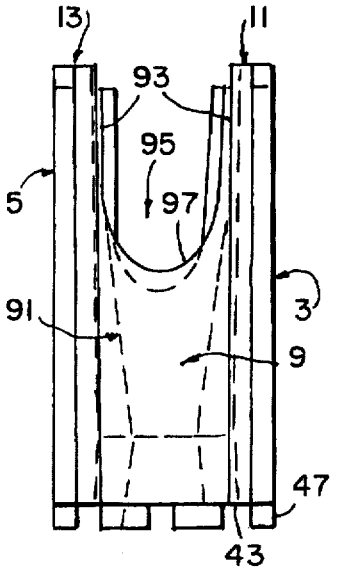
FIG. 5
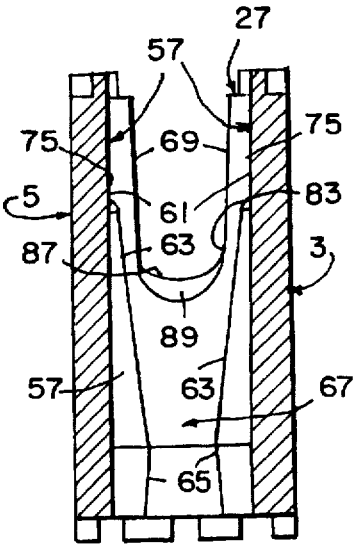
FIG. 6
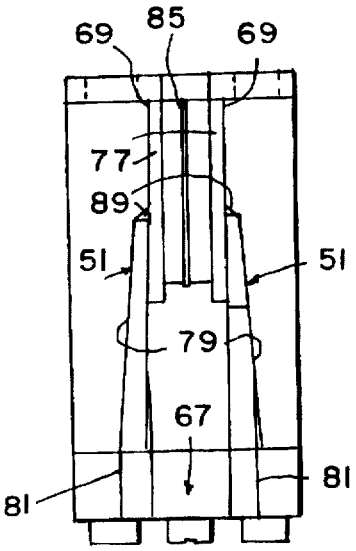
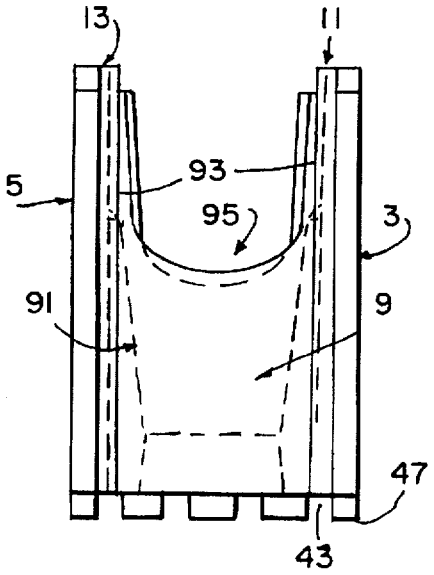
FIG. 10
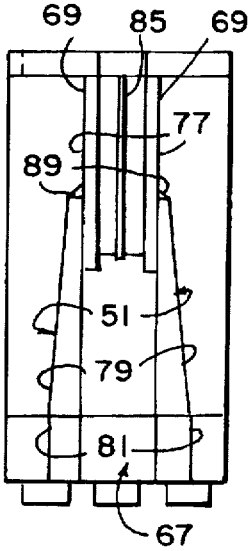
FIG. 12
FIG. 11
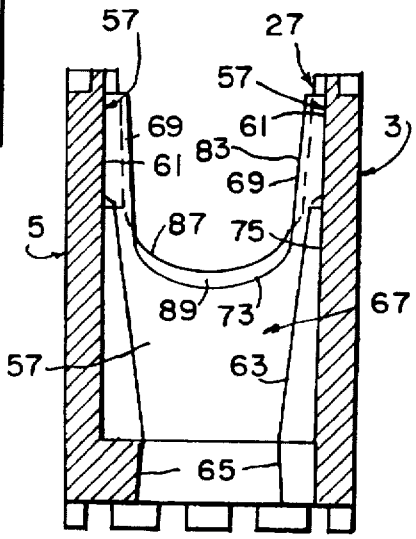

FOAM BUILDING BLOCK

BACKGROUND OF THE INVENTION

The present invention relates to interlocking building blocks for concrete structures.

Existing building blocks for wall construction have proven inadequate. Meeting industry demands and structural specifications have resulted in increased construction costs. To remain competitive, contractors need to be able to construct sturdy walls in less time using blocks that are universally compatible and economically competitive. Needs exist for building blocks that are not only easy to assemble and inexpensive to manufacture but that also provide increased strength and meet design load specifications.

SUMMARY OF THE INVENTION

A stackable and connectable foam building block is disclosed. The block includes a pair of generally parallel side walls and a pair of generally parallel end walls extending between far ends of the side walls. Multiple transverse members extend between the side walls at regular intervals for providing support and for defining cavities. Each end wall has a U-shaped cutout section at its top for permitting communication of concrete between cavities of adjacent blocks. The lower part of the cutout section gradually increases from the outer part of the end wall to the inner part of the end wall, thereby forming a downward and inward sloping cutout surface. Each transverse member includes a pair of structures identical to the end walls. The two structures are positioned back-to-back, such that each cutout surface slopes downward and inward from the middle of the transverse member towards the adjacent cavities.

The upper and lower edges of the side walls, the transverse members and the end walls include multiple spaced recesses. Upstanding members are defined by adjacent recesses. The recesses are positioned such that when identical blocks are stacked, the recesses and upstanding members cooperate and hold the blocks securely together. The inner side walls of the block defining the cavities have sloped portions. Each sloped portion originates approximately one-fourth of the way down the side wall from its top and slopes inward and downward. At approximately one-fourth the length of the side wall to its bottom, the sloped portion reverses its angle and slopes outward and downward. The sloped portions are angled near the connections of the transverse members or end walls to the side walls, thereby forming cavities having irregular, sloped octagonal shapes.

In preferred embodiments, the block has a height of 12 inches, a length of 48 inches and six cells that are each approximately 8 inches in length. The 12 inch standardized height provides for ease of construction to standard wall heights without adjustments to the blocks, thereby eliminating waste. The 48 inch standardized length and six 8 inch cell repeats also reduces waste. Preferably, each side wall has a width of approximately one inch, thereby reducing costs. End caps are constructed integral with the side walls of the block, thereby eliminating extra inventory items and reducing costs.

The block preferably has interlocking means as part of the exterior surfaces of the side walls and end caps. The interlocking patterns are universal for blocks of all sizes and allow for the connection of identical or different size blocks. That feature further reduces waste and allows builders to easily meet design load conditions.

The blocks are compatible with fur or batten strips for the attachment of drywall or exterior finishing, such as siding, without the use of expensive screws, nails or adhesives. By using furring on the interior, complications encountered by subcontractors, such as electrical, drywall and plumbing contractors, are reduced.

The present invention accepts standard cementious-based stuccos, thereby eliminating the need for costly synthetic stuccos.

The present block provides an excellent combination of interior and exterior insulation along with increased strength afforded by a form filled with reinforcing steel and concrete.

A building block includes a pair of generally parallel side walls and a pair of end walls extending between ends of the side walls. The side walls have upper edges, lower edges, outer surfaces and inner surfaces. The end walls have top edges, bottom edges, interior surfaces and exterior surfaces. Multiple transverse members are connected to and extend between the inner surfaces of the side walls. The transverse members have tops, bottoms and a pair of cavity-defining sides. Stacking elements are positioned along the upper edges and the lower edges of the side walls and along the top edges and the bottom edges of the end walls. Connectors are positioned on the end walls for laterally connecting blocks. The transverse members are spaced between the side walls, thereby dividing the block into multiple cavities. The transverse members are generally parallel to the end walls and are generally perpendicular to the side walls. The transverse members include main body portions, pairs of arms extending from the main body portions and U-shaped cutout portions defined by the arms, with outer edges of the main body portions and the arms joining the inner surfaces of the side walls of the block. The end walls include main parts, pairs of standing members extending from the main parts and generally U-shaped open regions defined by the standing members.

Multiple, generally vertical grooves are included in the outer surfaces of the side walls. The grooves in the outer surfaces of the side walls are positioned opposite where the transverse members join the inner surfaces of the side walls. Preferably, the transverse members include central longitudinal slits extending through the arm portions of the transverse members. The slits are aligned opposite adjacent vertical grooves in the outer surfaces of the side walls.

The stacking elements on the upper edges of the side walls include longitudinal rails extending substantially along the upper edges of the side walls, lateral connectors extending outward from the rails at generally right angles to the rails and recesses formed between adjacent lateral connectors. The stacking elements on the lower edges of the side walls include longitudinal channels extending substantially along the upper edges of the side walls, lateral channels extending outward from the longitudinal channels at generally right angles to the longitudinal channels, and standing elements positioned between adjacent lateral channels. The stacking elements of the upper edges and the lower edges are oriented such that the longitudinal rails of a lower block are received by the longitudinal channels of an upper block and the lateral connectors of the lower block are received by the lateral channels of the upper block. In another preferred embodiment the stacking elements on the lower edges of the side walls include longitudinal rails extending substantially along the lower edges of the side walls, lateral connectors extending outward from the rails at generally right angles to the rails and recesses formed between adjacent lateral connectors. In that embodiment, the stacking elements on the upper edges of the side walls include longitudinal channels extending substantially along the upper edges of the side walls, lateral channels extending outward from the longitudinal channels at generally right angles to the longitudinal channels, and standing elements positioned between adjacent lateral channels.

Inner surfaces of the side walls have generally vertical upper regions, inwardly sloping intermediate regions and outwardly sloping lower regions. The inner surfaces of the side walls preferably include curved portions extending substantially the entire height of the side walls at points where the side walls are joined to the transverse members and to the end walls.

The pairs of arms of the transverse members are generally vertical. The side surfaces of the main body portions of the transverse members have inwardly sloping upper regions and an outwardly sloping lower regions. The U-shaped cutout portions of the transverse members include central ridges and walls sloping downward from the ridges and meeting the sides of the main body portions.

The end walls preferably have widths that are approximately half of widths of the transverse members. The end walls include main body parts and pairs of standing members extending from opposite ends of upper edges of the body parts. The standing members define generally U-shaped cutouts. The walls of the cutouts slope downward and inward toward the cavity.

The connectors include extensions and recesses positioned oppositely on the end walls. The extensions and recesses mate with recesses and extensions, respectively, of adjacent blocks for connecting blocks in horizontal rows.

In preferred embodiments the side walls, the end walls and the transverse members are made of expanded polystyrene.

In one preferred embodiment, the block has five transverse members. The transverse members are spaced to define six, substantially identical cavities. Four cavities are defined by the side walls and two transverse members, and two cavities are defined by the side walls, one transverse member and one end wall.

The block may include transition walls having inner transition surfaces between inner surfaces of the side walls and side surfaces of the transverse members and inside surfaces of the end walls, thereby forming concrete-receiving cavities of generally octagonal horizontal cross-sections. The inner transition surfaces preferably slope inward and downward.

A building block includes a first side wall having first and second ends, a second side wall having first and second ends, spaced from the first side wall and positioned generally parallel to the first side wall, a first end wall positioned between and integral with the first ends of the side walls and a second end wall positioned between and integral with the second ends of the side walls. The end walls are generally perpendicular to the side walls and generally parallel to each other. Multiple transverse members extend between and are joined to the side walls. The transverse members are generally perpendicular to the side walls and generally parallel to the end walls and spaced from each other and from the end walls, thereby defining cavities. Connectors positioned on outer sides of the end walls connect the block to adjacent blocks in a horizontal row. Stackable elements are positioned on upper and lower surfaces of at least the side walls for securely stacking adjacent blocks. Inner surfaces of the side walls, end walls and transverse members define each cavity and include substantially vertical upper regions, inward and downward sloping intermediate regions and outward and downward sloping lower regions. The transverse members and end walls have generally U-shaped cutout regions. The end walls include main body portions having sides joined to the side walls and upper edges. Pairs of arms extend from the upper edges of the main body portions and have inner edges and outer edges. The outer edges are joined to the side walls and the inner edges define sides of the U-shaped cutout regions. The upper edges of the main body portions define bottom sections of the U-shaped cutout regions. The upper edges include downward and inwardly sloping walls that meet at lower edges with the inner surfaces of the main body portions of the transverse members. The transverse members are pairs of end walls positioned back-to-back. Vertical grooves are located in outer surfaces of the side walls at positions where the transverse members are connected to the side walls. The side walls defining each cavity include curved parts at regions where the side wall meets the transverse members or one transverse member and one side wall.

A building barrier structure includes laterally and vertically locking hollow foam blocks. Each block includes plural vertical, generally octagonal cavities having downward and inward then downward and outward sloping walls and inward and downward then outward and downward sloping transitional corner sections.

These and further and other objects and features of the invention are apparent in the disclosure, which includes the above and ongoing written specification, with the claims and the drawings.

BRIEF DESCRIPTION OF THE DRAWINGS

FIG. 4 is a side view of the block of FIG. 1.

FIG. 5 is a cross-sectional view of FIG. 1 along A—A.

FIG. 6 is a cross-sectional view of FIG. 1 along B—B.

FIG. 10 is a side view of the block of FIG. 7.

FIG. 11 is a cross-sectional view of FIG. 7 along C—C.

FIG. 12 is a cross-sectional view of FIG. 7 along D—D.

DETAILED DESCRIPTION OF THE PREFERRED EMBODIMENTS

Figure 1:
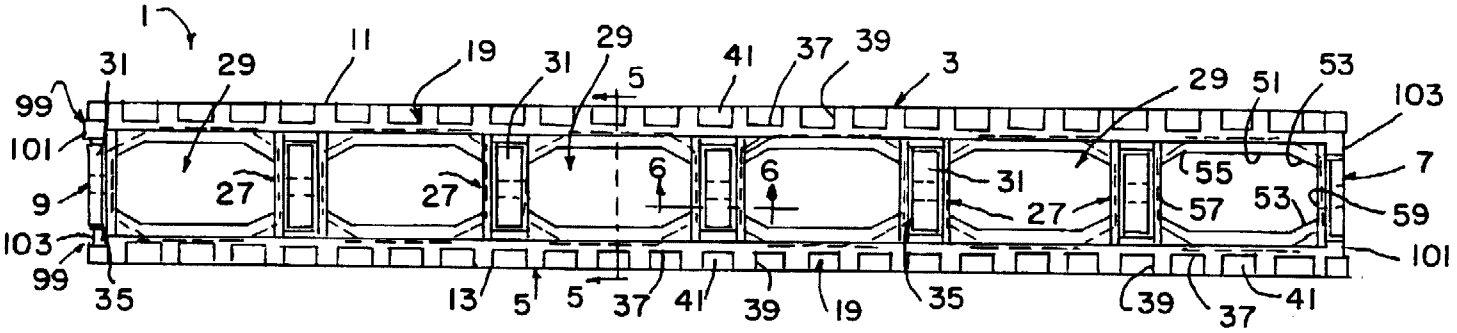
FIG. 1 is a plan view of a building block having a six inch width.

As shown in the figures, the present invention is a building block 1 having a pair of generally parallel side walls 3, 5 and a pair of generally parallel end walls 7, 9 extending between far ends of the side walls 3, 5. The upper edges 11, 13 and lower edges 15, 17 of the side walls 3, 5 have stackable interlocking surfaces 19, 21 for securely connecting blocks to identical blocks positioned above and below. Vertical grooves 23 are formed in the outer surfaces 25 of the side walls 3, 5 for facilitating cutting of the block. Multiple transverse members 27 extend between the side walls 3, 5 of the block 1, thereby defining multiple concrete-receiving cavities 29. Any number of transverse members 27 may be included. Preferably, the upper edges 31 and lower edges 33 of the transverse members 27 and the end walls 7, 9 have stackable surfaces 35 for securely connecting the block to identical blocks positioned above and below.

As shown in FIGS. 1–3 and 7–9, the upper edges 11, 13 and the lower edges 15, 17 of the side walls 3, 5 have stackable, locking surfaces 19, 21. In preferred embodiments, the surfaces 19, 21 of the upper edges 11, 13 include a longitudinal rail 37 extending substantially along the upper edges 11, 13 of the side walls 3, 5. Lateral connectors 39 extend outward from the rail 37 at generally right angles to the rail 37. Recesses 41 are formed between adjacent lateral connectors 39. The lower edges 15, 17 of the side walls 3, 5 include a longitudinal channel 43 extending substantially along the lower edges 15, 17 of the side walls 3, 5. Lateral channels 45 extend outward from the longitudinal channel 43 at generally right angles to the longitudinal channel 43. Upstanding members 47 are formed between the lateral channels 45. When blocks are stacked, the longitudinal channels 43 and lateral channels 45 of a first, upper block receive the longitudinal rails 37 and lateral connectors 39, respectively, of a second, lower block. Similarly, the recesses 41 of the lower block receive the upstanding members 47 of the upper block.

Preferably, the upper edges 31 and lower edges 33 of the end walls 7, 9 and transverse members 27 have stackable surfaces 35 identical to the upper edges 11, 13 and lower edges 15, 17, respectively, of the side walls 3, 5.

Importantly, the arrangements of the channels, rails, upstanding members and recesses may be reversed. For example, the rails 37 may be on the lower edges and the longitudinal channels 43 on the upper edges. The number and size of the lateral channels 45 and lateral connectors 39 may also vary, with any variation being acceptable.

As shown in FIGS. 1–2 and 7–8, cavities 29 for receiving bars and concrete are defined by the side walls 3, 5 and either a pair of adjacent transverse members 27 or one transverse member 27 and an end wall 7 or 9. The inner surfaces 51 of the side walls 3, 5 are sloped and curved. As shown in the figures, each cavity 29 has an octagonal horizontal cross-section, with the inner surfaces 51 of the side walls 3, 5 having curved portions 53 where the side walls 3, 5 meet the transverse member 27 or end wall 7 or 9. In preferred embodiments, the curved portions 53 are transition walls having inner transition surfaces 55 between inner surfaces 51 of the side walls 3, 5 and side surfaces 57 of the transverse members 27 and inside surfaces 59 of the end walls 7, 9, thereby forming concrete-receiving cavities 29 of generally octagonal horizontal cross-sections. The inner transition surfaces 55 preferably slope inward and downward.

As shown in FIGS. 5 and 11, the inner surfaces 51 of the side walls 3, 5 vary from top to bottom. Preferably, the inner surfaces 51 have generally vertical upper regions 61, inwardly sloping intermediate regions 63 and outwardly sloping lower regions 65.

FIGS. 1–12 show preferred embodiments of the transverse members 27. The transverse members 27 are identical, with each member 27 including a main body portion 67 and a pair of arms 69 extending from upper edges 73 the main body portion 67. Outer edges 75 of the main body portion 67 and arms 69 contact and engage the inner surfaces 51 of the side walls 3, 5 of the block 1. The side surfaces 57 of each transverse member 27 define sides of the adjoining cavities 29. As shown in FIGS. 6 and 12, the side surfaces 57 of the transverse members 27 are similar to the inner surfaces 51 of the side walls 3, 5: generally vertical upper regions 77, inwardly sloping intermediate regions 79 and outwardly sloping lower regions 81.

A U-shaped cutout region 83 is defined by the arms 69 of each transverse member 27. That region 83 allows communication of concrete between adjacent cavities 29 and provides a channel for horizontally positioning a crossbar.

As shown in FIGS. 5–6 and 11–12, each transverse member 27 has a central longitudinal slit 85 that extends less than half the length of the member 27. When the transverse member 27 is positioned between the side walls 3, 5, the central slit 85 lies in the same vertical plane as the vertical grooves 23 in the outer surfaces 25 of the side walls 3, 5. The slit and grooves 23 serve to facilitate cutting of the block.

As shown in FIGS. 5 and 11, the U-shaped region 83 defined by the arms 69 has a central ridge 87 and sloping walls 89 extending downward from the central ridge 87. The sloping walls 89 join the side surfaces 57 of the transverse member 27 at their lower edges.

As shown in FIGS. 4 and 10, each end wall 7, 9 is preferably a transverse member 27 split in half. The end walls 7, 9 include main body parts 91, pairs of standing members 93 extending from the main body parts 91 and generally U-shaped open regions 95 defined by the standing members 93. The walls 97 of the U-shaped regions 95 slope inward towards the cavity 29.

Figure 2:
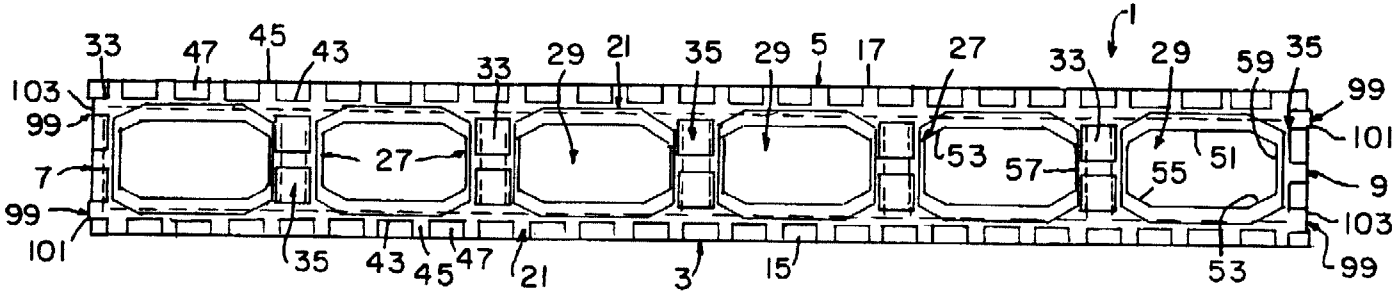
FIG. 2 is a bottom view of the block of FIG. 1.
Figure 3:
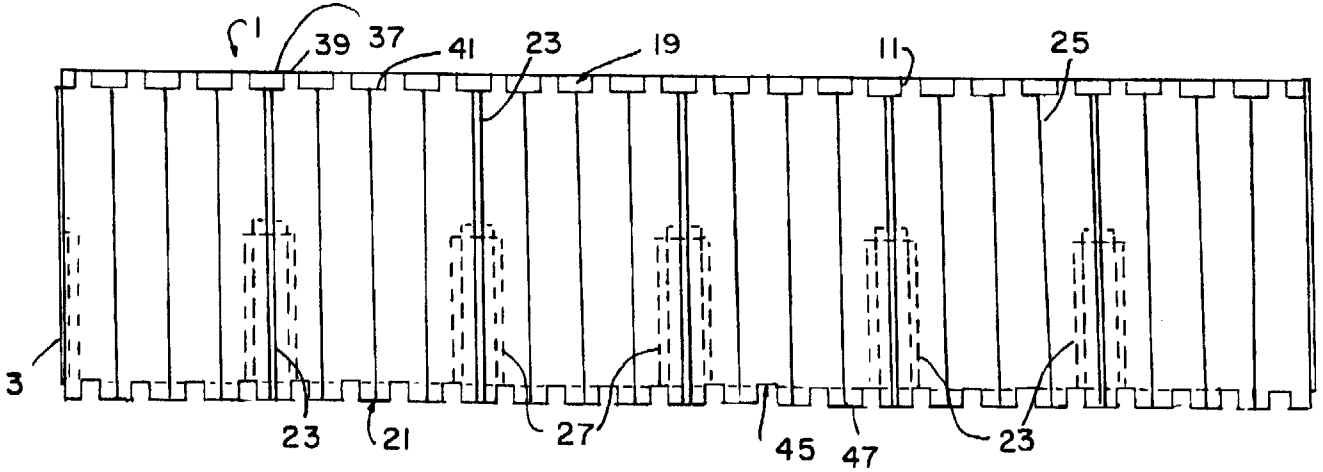
FIG. 3 is a front view of the block of FIG. 1.
Figure 7:
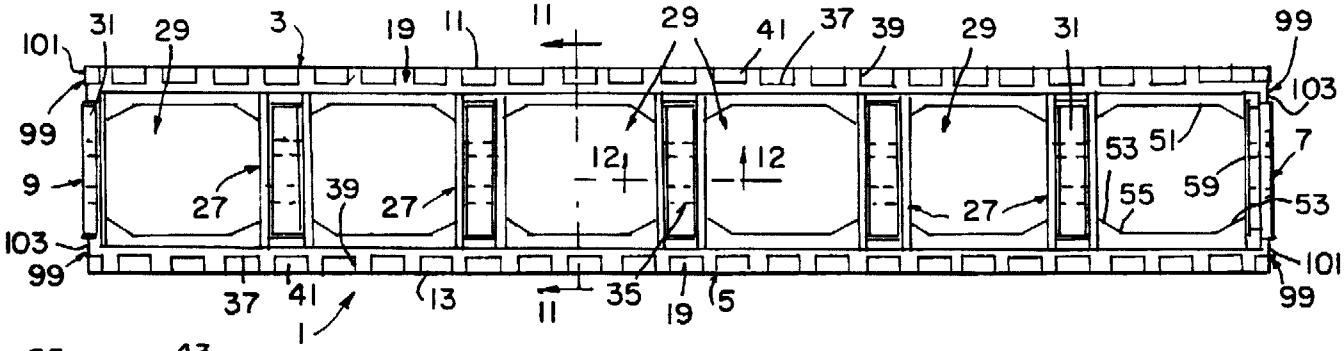
FIG. 7 is a top view of a building block having an eight inch width.
Figure 8:
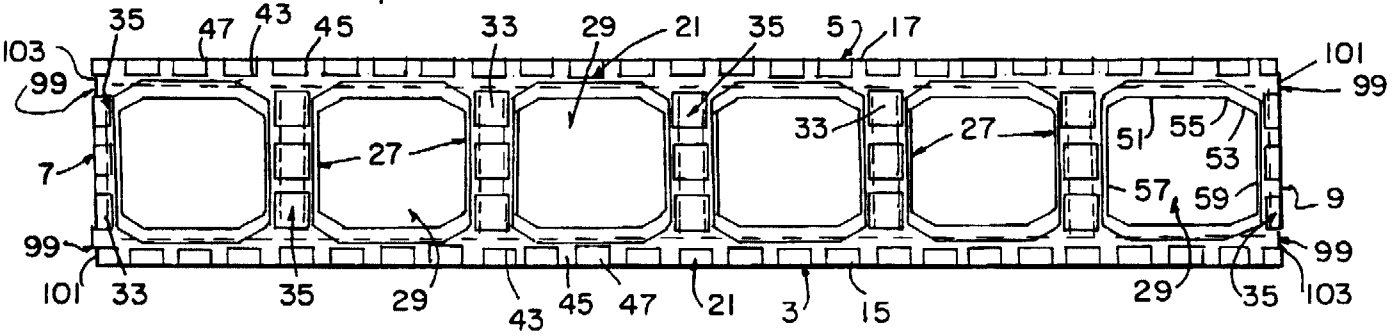
FIG. 8 is a bottom view of the block of FIG. 7.
Figure 9:
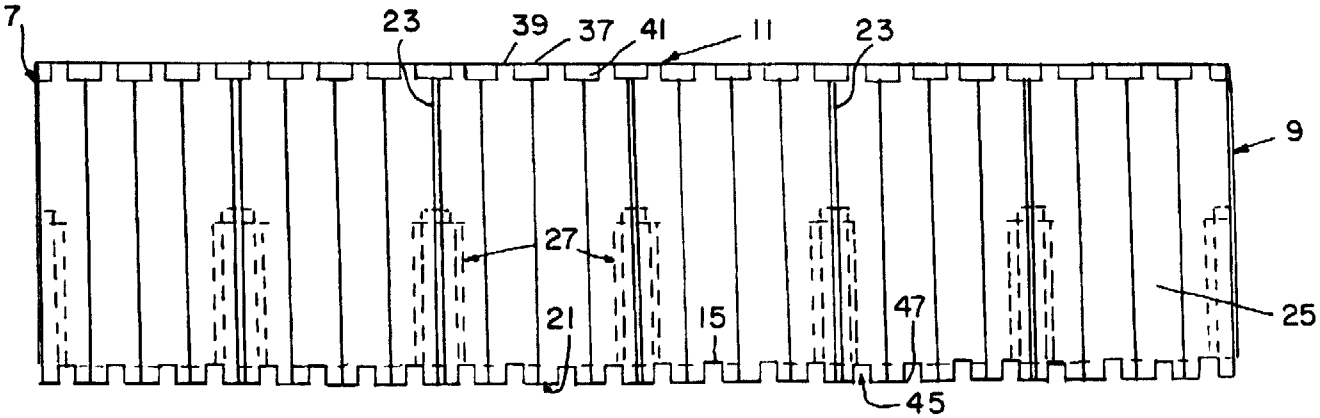
FIG. 9 is a front view of the block of FIG. 7.

The block 1 preferably has connectors 99 for interlocking identical blocks end-to-end. As shown in FIGS. 1 and 2, the upper edges and lower edges of the end walls 7, 9 include extensions 101 and a recesses 103. The extensions 101 and recesses 103 of the block mate with the recesses 103 and extensions 101, respectively, of adjacent blocks for connecting blocks in a horizontal row.

FIGS. 1–6 show an embodiment of the present invention having a width of six inches. FIGS. 7–12 show an embodiment of the present invention having width of eight inches.

The dimensions of the box may vary, depending on intended use and building regulations. In a preferred embodiments, the block has a height of approximately 12 inches, a length of approximately 48 inches, a form wall of approximately one inch and overall width of approximately 6 inches, as shown in FIGS. 1–6, or approximately 8 inches, as shown in FIGS. 7–12. Those dimensions fall into uniform standard sizes, are compatible with national standard building products and reduce the amount of used floor space. Importantly, the inclusion of one inch form walls allows for the use of furring strips, thereby resulting in no compromise or change from standard construction techniques for electricians, plumbers or drywall contractors.

The block is preferably made of expanded polystyrene.

The blocks are connected end-to-end and stacked to form a wall. Crossbars are vertically inserted in the wall through the cavities of stacked blocks. Crossbars may also be horizontally laid across the transverse members of adjacent blocks. Next, concrete is poured into the cavities. As the concrete hardens, a lattice of integrally connected undulating polygonal concrete columns supported by horizontal and vertical crossbars is formed.

While the invention has been described with reference to specific embodiments, modifications and variations of the invention may be constructed without departing from the scope of the invention.

We claim:

1. A building block apparatus comprising a pair of generally parallel side walls, the side walls having upper edges, lower edges, outer surfaces and inner surfaces, a pair of end walls extending between ends of the side walls, the end walls having top edges, bottom edges, interior surfaces and exterior surfaces, multiple transverse members connected to and extending between the inner surfaces of the side walls, wherein the transverse members have tops, bottoms and a pair of cavity-defining sides, stacking elements positioned along the upper edges and the lower edges of the side walls and along the top edges and the bottom edges of the end walls, and connectors positioned on the end walls, wherein the transverse members are spaced between the side walls, thereby dividing the block into multiple cavities, wherein the transverse members are generally parallel to the end walls and are generally perpendicular to the side walls, wherein the transverse members further comprise main body portions, pairs of arms extending from the main body portions and U-shaped cutout portions defined by the arms, with outer edges of the main body portions and the arms joining the inner surfaces of the side walls of the block, and wherein the end walls further comprise main parts, pairs of standing members extending from the main parts and generally U-shaped open regions defined by the standing members, wherein the pairs of arms are generally vertical and wherein the side surfaces of the main body portions have inwardly sloping upper regions and outwardly sloping lower regions.

2. The apparatus of claim 1, further comprising multiple generally vertical grooves in the outer surfaces of the side walls.

3. The apparatus of claim 2, wherein the grooves in the outer surfaces of the side walls are positioned opposite where the transverse members join the inner surfaces of the side walls.

4. The apparatus of claim 1, wherein the stacking elements on the upper edges of the side walls further comprise longitudinal rails extending substantially along the upper edges of the side walls, lateral connectors extending outward from the rails at generally right angles to the rails and recesses formed between adjacent lateral connectors, wherein the stacking elements on the lower edges of the side walls further comprise longitudinal channels extending substantially along the upper edges of the side walls, lateral channels extending outward from the longitudinal channels at generally right angles to the longitudinal channels, and standing elements positioned between adjacent lateral channels, and wherein the stacking elements of the upper edges and the lower edges are oriented such that the longitudinal rails of a lower block are received by the longitudinal channels of an upper block and the lateral connectors of the lower block are received by the lateral channels of the upper block.

5. The apparatus of claim 1, wherein the stacking elements on the lower edges of the side walls further comprise longitudinal rails extending substantially along the lower edges of the side walls, lateral connectors extending outward from the rails at generally right angles to the rails and recesses formed between adjacent lateral connectors, wherein the stacking elements on the upper edges of the side walls further comprise longitudinal channels extending substantially along the upper edges of the side walls, lateral channels extending outward from the longitudinal channels at generally right angles to the longitudinal channels, and standing elements positioned between adjacent lateral channels, and wherein the stacking elements of the upper edges and the lower edges are oriented such that the longitudinal rails of an upper block are received by the longitudinal channels of a lower block and the lateral connectors of the upper block are received by the lateral channels of the lower block.

6. The apparatus of claim 1, wherein the U-shaped cutout portions of the transverse members further comprise central ridges and walls sloping downward from the ridges and meeting the sides of the main body portions.

7. The apparatus of claim 1, wherein the end walls have widths that are approximately half of widths of the transverse members.

8. The apparatus of claim 7, wherein walls of the U-shaped open regions of the end walls slope downward and inward toward the cavity.

9. The apparatus of claim 1, wherein the connectors further comprise extensions and recesses positioned oppositely on the end walls, and wherein the extensions and recesses mate with recesses and extensions, respectively, of adjacent blocks for connecting blocks in horizontal rows.

10. The apparatus of claim 1, wherein the side walls, the end walls and the transverse members are made of expanded polystyrene.

11. The apparatus of claim 1, wherein the block has five transverse members, wherein the transverse members are spaced to define six, substantially identical cavities, and wherein four cavities are defined by the side walls and two transverse members, and wherein two cavities are defined by the side walls, one transverse member and one end wall.

12. The apparatus of claim 1, further comprising transition walls having inner transition surfaces between inner surfaces of the side walls and side surfaces of the transverse members and inside surfaces of the end walls, thereby forming concrete-receiving cavities of generally octagonal horizontal cross-sections.

13. The apparatus of claim 12, wherein the inner transition surfaces slope inward and downward.

14. A building block apparatus comprising a pair of generally parallel side walls, the side walls having upper edges, lower edges, outer surfaces and inner surfaces, a pair of end walls extending between ends of the side walls, the end walls having top edges, bottom edges, interior surfaces and exterior surfaces, multiple transverse members connected to and extending between the inner surfaces of the side walls, wherein the transverse members have tops, bottoms and a pair of cavity-defining sides, stacking elements positioned along the upper edges and the lower edges of the side walls and along the top edges and the bottom edges of the end walls, and connectors positioned on the end walls, wherein the transverse members are spaced between the side walls, thereby dividing the block into multiple cavities, wherein the transverse members are generally parallel to the end walls and are generally perpendicular to the side walls, wherein the transverse members further comprise main body portions, pairs of arms extending from the main body portions and U-shaped cutout portions defined by the arms, with outer edges of the main body portions and the arms joining the inner surfaces of the side walls of the block, and wherein the end walls further comprise main parts, pairs of standing members extending from the main parts and generally U-shaped open regions defined by the standing members, wherein the transverse members further comprise central longitudinal slits extending through the arm portions of the transverse members, wherein the slits are aligned opposite adjacent vertical grooves in the outer surfaces of the side walls.

15. A building block apparatus comprising a pair of generally parallel side walls, the side walls having upper edges, lower edges, outer surfaces and inner surfaces, a pair of end walls extending between ends of the side walls, the end walls having top edges, bottom edges, interior surfaces and exterior surfaces, multiple transverse members connected to and extending between the inner surfaces of the side walls, wherein the transverse members have tops, bottoms and a pair of cavity-defining sides, stacking elements positioned along the upper edges and the lower edges of the side walls and along the top edges and the bottom edges of the end walls, and connectors positioned on the end walls, wherein the transverse members are spaced between the side walls, thereby dividing the block into multiple cavities, wherein the transverse members are generally parallel to the end walls and are generally perpendicular to the side walls, wherein the transverse members further comprise main body portions, pairs of arms extending from the main body portions and U-shaped cutout portions defined by the arms, with outer edges of the main body portions and the arms joining the inner surfaces of the side walls of the block, and wherein the end walls further comprise main parts, pairs of standing members extending from the main parts and generally U-shaped open regions defined by the standing members, wherein the inner surfaces of the side walls have generally vertical upper regions, inwardly sloping intermediate regions and outwardly sloping lower regions.

16. The apparatus of claim 15, wherein the inner surfaces of the side walls further comprise curved portions extending substantially an entire height of the side walls at points where the side walls are joined to the transverse members and to the end walls.

17. A building block apparatus comprising a first side wall having first and second ends, a second side wall having first and second ends, spaced from the first side wall and positioned generally parallel to the first side wall, a first end wall positioned between and integral with the first ends of the side walls, a second end wall positioned between and integral with the second ends of the side walls, wherein the end walls are generally perpendicular to the side walls and generally parallel to each other, multiple transverse members extending between and connected to the side walls, wherein the transverse members are generally perpendicular to the side walls and generally parallel to the end walls and spaced from each other and from the end walls, thereby defining cavities, connectors positioned on outer sides of the end walls for connecting the block to adjacent blocks in a horizontal row, stackable elements positioned on upper and lower surfaces of at least the side walls for securely stacking adjacent blocks, wherein inner surfaces of the side walls, end walls and transverse members defining each cavity further comprise substantially vertical upper regions, inward and downward sloping intermediate regions and outward and downward sloping lower regions, and wherein the transverse members and end walls have generally U-shaped cutout regions.

18. The apparatus of claim 17, wherein the end walls further comprise main body portions having sides joined to the side walls and upper edges, pairs of arms extending from the upper edges of the main body portions and having inner edges and outer edges, wherein the outer edges are joined to the side walls and wherein the inner edges define sides of the U-shaped cutout regions, and wherein the upper edges of the main body portions define bottom sections of the U-shaped cutout regions, the upper edges further comprising downward and inwardly sloping walls that meet at lower edges with the inner surfaces of the main body portions of the transverse members.

19. The apparatus of claim 18, wherein the transverse members further comprise pairs of end walls positioned back-to-back.

20. The apparatus of claim 17, further comprising vertical grooves in outer surfaces of the side walls at positions where the transverse members are connected to the side walls.

21. The apparatus of claim 17, wherein the side walls defining each cavity further comprise curved parts at regions where the side wall meets the transverse members or one transverse member and one side wall.

22. A building barrier structure comprising laterally and vertically locking hollow foam blocks, the blocks further comprising plural vertical, generally octagonal cavities having downward and inward then downward and outward sloping walls and inward and downward then outward and downward sloping transitional corner sections.

* * * * *